US012042709B1

(12) United States Patent
Williams

(10) Patent No.: US 12,042,709 B1
(45) Date of Patent: Jul. 23, 2024

(54) FIGHTING TRAINING DEVICE

(71) Applicant: Craig E. Williams, Santa Barbara, CA (US)

(72) Inventor: Craig E. Williams, Santa Barbara, CA (US)

( * ) Notice: Subject to any disclaimer, the term of this patent is extended or adjusted under 35 U.S.C. 154(b) by 197 days.

(21) Appl. No.: 17/676,973

(22) Filed: Feb. 22, 2022

(51) Int. Cl.
*A63B 69/22* (2006.01)
*A63B 69/20* (2006.01)
*A63B 69/24* (2006.01)

(52) U.S. Cl.
CPC ..... *A63B 69/22* (2022.08); *A63B 69/20* (2013.01); *A63B 69/24* (2013.01); *A63B 2210/50* (2013.01)

(58) Field of Classification Search
CPC ..... A63B 69/22; A63B 69/20; A63B 69/215; A63B 69/222; A63B 69/224; A63B 21/00047; A63B 2210/50
See application file for complete search history.

(56) References Cited

U.S. PATENT DOCUMENTS

| | | | | |
|---|---|---|---|---|
| 2,435,864 | A | 2/1948 | Adams | |
| D265,333 | S | 7/1982 | Lee | |
| 5,046,724 | A | 9/1991 | Sotomayer | |
| 5,183,451 | A | 2/1993 | Hautamaki | |
| 5,256,069 | A | 10/1993 | Snowden, Jr. et al. | |
| 5,352,170 | A * | 10/1994 | Condo | A63B 69/222 482/83 |
| D356,127 | S | 3/1995 | Mara | |
| 7,086,997 | B1 | 8/2006 | Fields et al. | |
| D584,785 | S | 1/2009 | McDonald | |
| D675,696 | S | 2/2013 | Fu et al. | |
| D816,788 | S | 5/2018 | Chen | |
| 2007/0167297 | A1* | 7/2007 | Stevenson | A63B 71/023 482/90 |
| 2007/0197348 | A1* | 8/2007 | Ku | A63B 69/222 482/90 |
| 2009/0247374 | A1* | 10/2009 | Chen | A63B 69/22 482/89 |
| 2014/0302969 | A1* | 10/2014 | Chen | A63B 69/224 482/90 |
| 2021/0402275 | A1* | 12/2021 | Garcia | A63B 69/22 |

* cited by examiner

*Primary Examiner* — Megan Anderson
(74) *Attorney, Agent, or Firm* — Cramer Patent & Design PLLC; Aaron R. Cramer

(57) ABSTRACT

A fighting training device is a fighting training system that utilizes multiple slapper pads. The pads are attached along a vertical post that is supported by a base. Handles of the slapper pads are secured via a "grip box" in which two halves encompass the handle and are secured together and to the vertical post with at least one fastener. An interior holding area is provided with long spikes which prevent the slapper pads from spinning when hit. During use, the pads are arranged according to the height of the user and the desired workout, preferably at ninety degree (90°) alternating angles. Such features provide for a full range of motion including kicking at all heights up to six feet high. The post folds in half to facilitate easy storage.

4 Claims, 5 Drawing Sheets

FIGHTING TRAINING DEVICE

RELATED APPLICATIONS

None.

FIELD OF THE INVENTION

The presently disclosed subject matter is directed to a training device and more specifically to a training device for fighters.

BACKGROUND OF THE INVENTION

Participation in fighting and martial arts has remained popular for most of the recorded history of mankind. The pure exhilaration of engaging an opponent with only one coming out a winner purely on the basis of physical strength and skill is something that many people cannot resist. Many matches are one and lost on one's ability to punch and kick their opponent properly and effectively.

Unfortunately, it is very difficult to coach or train a participant due to the difficulty of producing a suitable target. Other players can be used, but such action places them in danger and subject to injuries. Additionally, many people do not have the luxury of a sparring partner. Slapper pads may be used to help address some of these shortcomings, but once again, another person is needed to hold the pads. Accordingly, there exists a need for a means by which effective training for fighting can be provided without the requirement of another person. The development of the fighting training device fulfills this need.

SUMMARY OF THE INVENTION

The principles of the present invention provide for a fighting training device that has, a base supporting a center mounted tower assembly, at least one strike pad holding the center mounted tower assembly, a first fastening means connecting the center mounted tower assembly to the base, and an upper pole segment and a lower pole segment connected by a hinge. The lower pole segment is attached to the base via a plurality of second fastening means.

The center mounted tower assembly may hold the at least one strike pad via a respective holding block. The fighting training device may further comprise a plurality of threaded holes disposed on the center mounted tower assembly that may be utilized when attaching the respective holding block. The threaded holes may be 3 inches on center to allow for personalized spacing of the respective holding block and the at least one strike pad. The center mounted tower assembly holding the at least one strike pad and associated tower assembly may be placed on the center mounted tower assembly along a pad placement area "a".

The pad placement area "a" may be adapted to accommodate a user of a plurality of heights. The user may generate one or more hand strike travel paths "h", or one or more foot strike travel paths "f" directed at the at least one strike pad to improve skills. The user may generate one or more hand strike travel paths "h" and one or more foot strike travel paths "f" directed at the at least one strike pad to improve skills. The pad placement area "a" may be adapted to accommodate one or more specialized motions in boxing, mixed martial arts, kick boxing, karate, jiu-jitsu, judo, and taekwondo. The at least one strike pad may include 4 strike pads. The at least one strike pad may be sold separate from the fighting training device. Each of the at least one strike pad may include a handle. The handle of each of the at least one strike pad may be contained within an inner block and an outer block of the respective holding block. A plurality of third fastening means may be inserted through a plurality of through holes disposed on the inner block and the outer block and into a plurality of threaded holes disposed on the upper pole segment and the lower pole segment. The third fastening means may be tightened or loosened into the upper pole segment or the lower pole segment with only hand pressure as no tool would be required to allows for quick and easy customization of placement of the at least one strike pad along the pad placement area "a".

The handle of the at least one strike pad may be contained within a sleeve within the respective holding block. The horizontal cylindrical segment may be lined with a plurality of spikes disposed inside of the horizontal cylindrical segment to aid in gripping the handle. The first fastening means may be a plurality of bolts. The first fastening means may be a plurality of screws. The hinge may allow the center mounted tower assembly to be folded in half along a collapsing travel path of 180° to allow for easy transport in a container.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
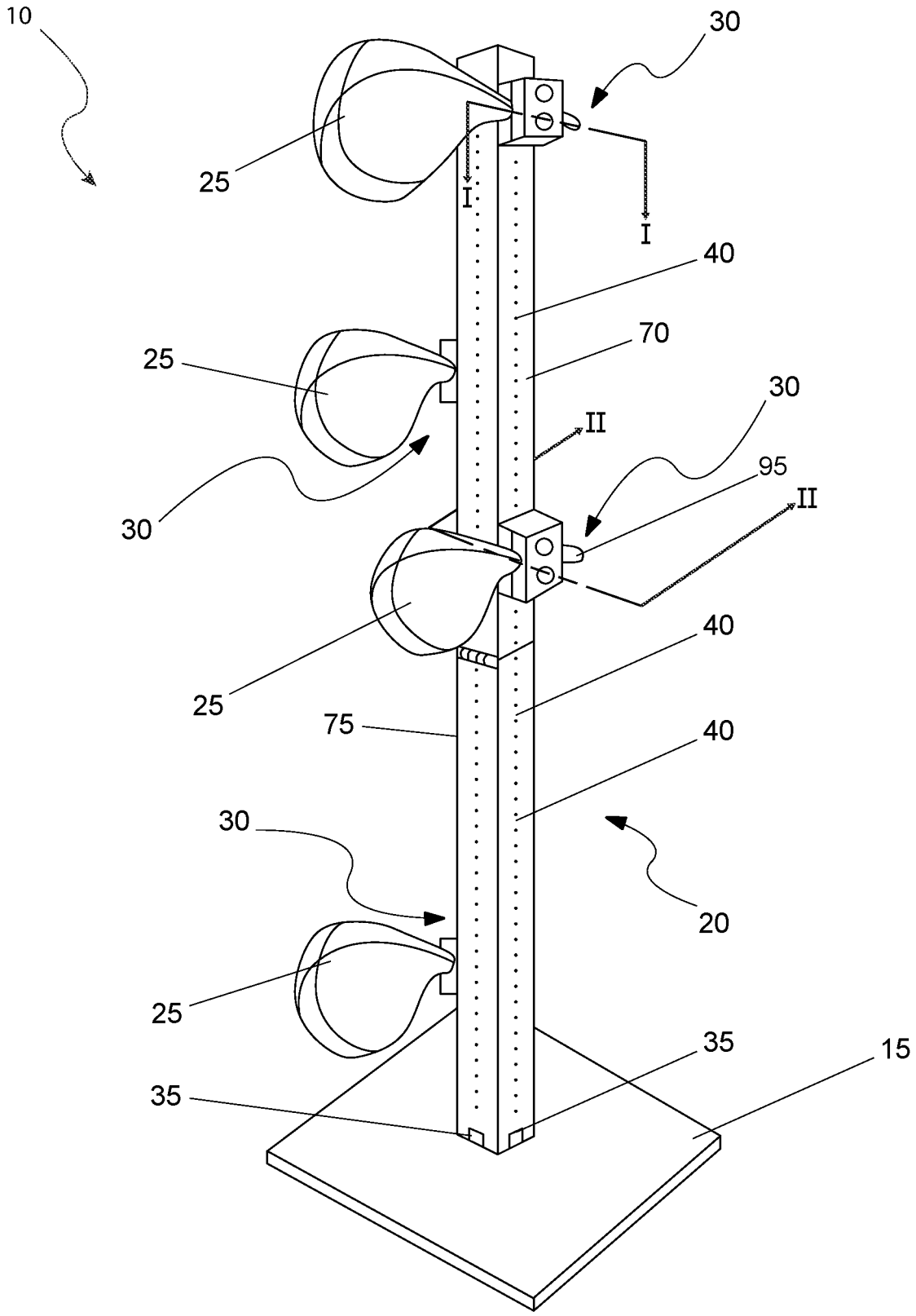
FIG. 1 is a perspective view of the fighting training device, according to the preferred embodiment of the present invention.

10 fighting training device
15 base
20 tower assembly
25 strike pad
30 holding block
35 first fastening means
40 threaded hole
45 user
50 sporting attire
55 pad placement area "a"
60 hand strike travel path "h"
65 foot strike travel path "f"
70 upper pole segment
75 lower pole segment
80 hinge
85 collapsing travel path "c"
90 second fastening means
95 handle
100 inner block

105 outer block
110 third fastening means
115 through hole
120 sleeve
125 horizontal cylindrical segment
130 spike

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the fighting training device 10, according to the preferred embodiment of the present invention is disclosed. The fighting training device (herein also described as the "device") 10, provides for the training of at least one (1) user at a time in various fighting moves such as strikes, punches, and kicks used in various fighting sports to provide a true interactive fighting experience without the need for a trainer or other participant. The device 10 includes base 15 supporting a center mounted tower assembly 20. The tower assembly 20 is envisioned to be approximately six feet (6 ft.) tall. The tower assembly 20 holds at least one (1) and preferable four (4) strike pads 25. They are held in place via a respective holding block 30 which will be described in greater detail herein below. The strike pads 25 are conventional in nature and are envisioned to be supplied with the device 10 or may be supplied by the final user 45 for use with the device 10. The tower assembly 20 connects to the base 15 via first fastening means 35 such as bolts, screws, or the like. The exact method provided by the first fastening means 35 is not intended to be a limiting factor of the present invention. The tower assembly 20 is provided with a set of threaded holes 40 that are utilized when attaching the holding blocks 30. The threaded holes 40 are envisioned to be approximately three inches (3 in.) on center. The spacing allows for personalized spacing of the holding blocks 30 and thus the strike pads 25.

Figure 2:
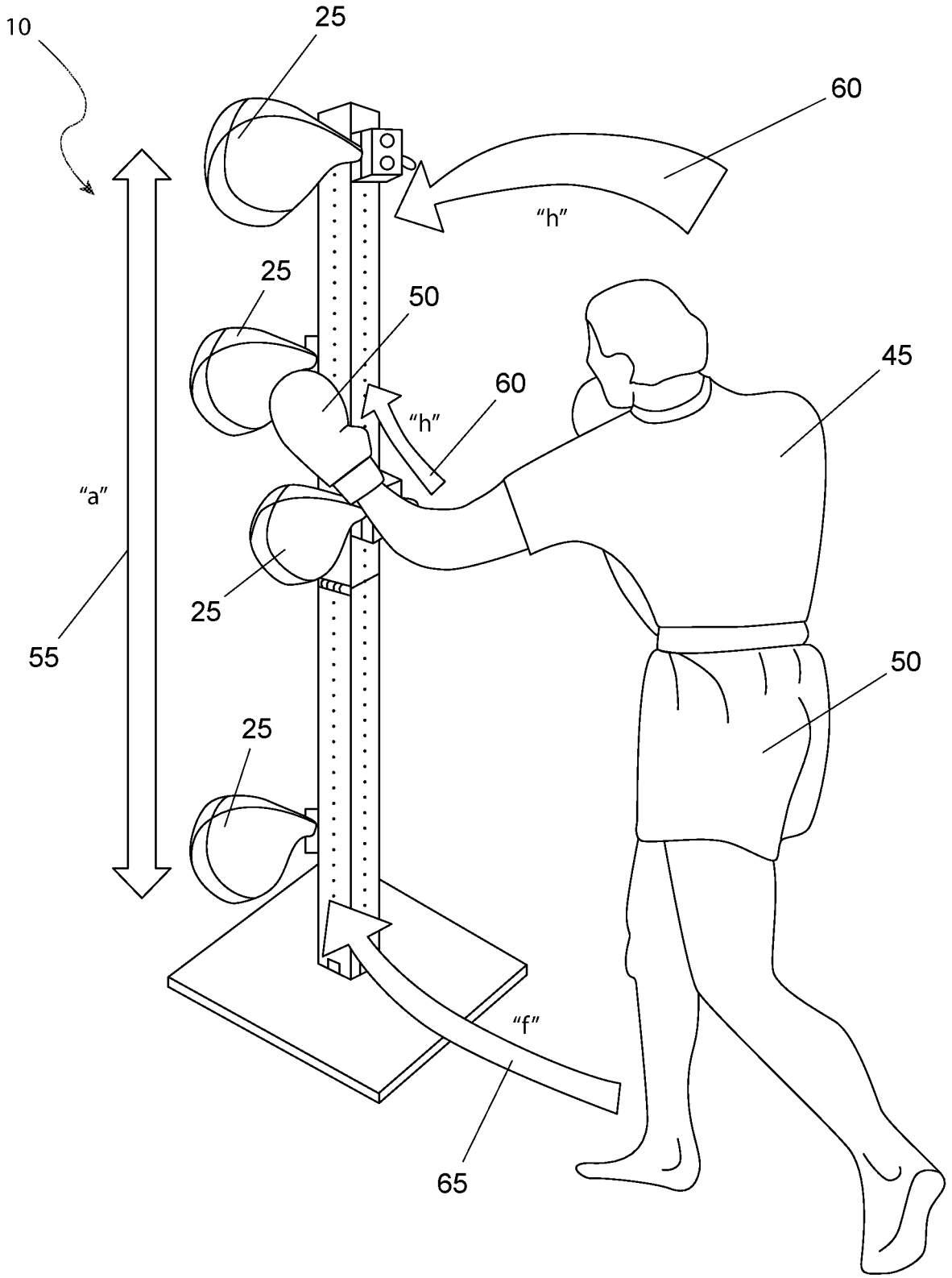
FIG. 2 is a perspective view of the fighting training device, shown in a utilized state, according to the preferred embodiment of the present invention.

Referring next to FIG. 2, a perspective view of the device 10, shown in a utilized state, according to the preferred embodiment of the present invention is depicted. A user 45, equipped with proper sporting attire 50, such as trunks, gloves, and the like, utilizes the device 10 in much the same manner as a sparring partner or coach. The strike pads 25 and associated tower assembly 20 are placed on the tower assembly 20, along a pad placement area "a" 55. This pad placement area "a" 55 accommodates user 45 of different heights or accommodates specialized motions that are usually practiced by a user 45 practicing boxing, mixed martial arts, kick boxing, karate, jiu-jitsu, judo, taekwondo, or the like. The exact type of practice used with the device 10 is not intended to be a limiting factor of the present invention. During use, the user 45 will produce hand strike travel paths "h" 60 and/or foot strike travel paths "f" 65 directed at the strike pads 25 to improve skills.

Figure 3:
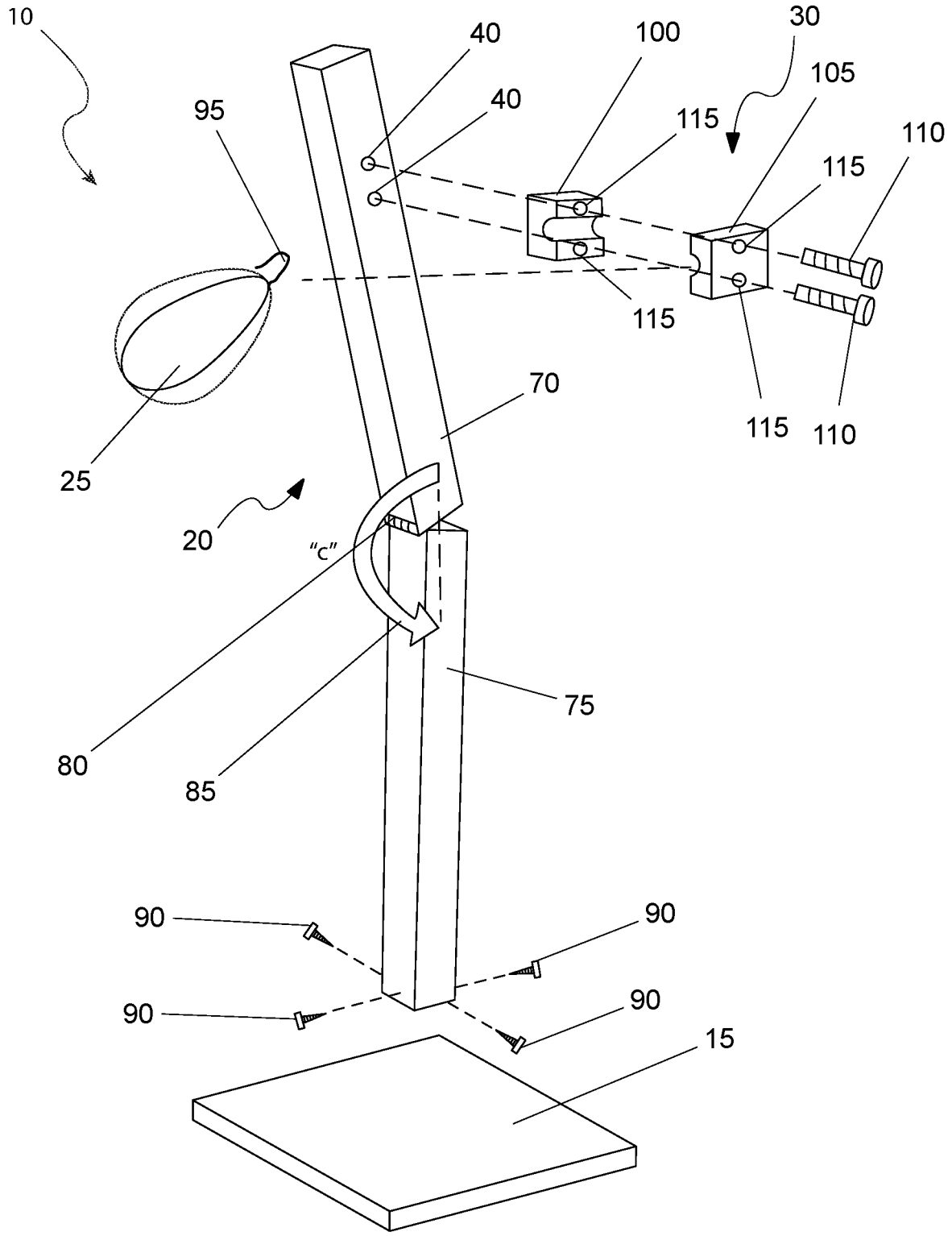
FIG. 3 is an exploded diagram view of the fighting training device, according to the preferred embodiment of the present invention.

Referring now to FIG. 3, an exploded diagram view of the device 10, according to the preferred embodiment of the present invention is shown. The tower assembly 20 includes an upper pole segment 70 and a lower pole segment 75 connected by a hinge 80. The hinge 80 allows the tower assembly 20 to be folded in half along a collapsing travel path "c" 85 of approximately one-hundred-eighty degrees (180°) to allow for easy transport, perhaps in a bag or case. The lower pole segment 75 is attached to the base 15 via multiple second fastening means 90. The handle 95 of the strike pads 25 (of which only one (1) is shown in an effort to improve illustrative simplicity) is contained within an inner block 100 and an outer block 105 which form the holding blocks 30. At least two (2) third fastening means 110, such as bolts or thumbscrews, are inserted through the through holes 115 in the inner block 100 and the outer block 105 and into the threaded holes 40 (of which only two (2) are shown due to illustrative simplicity) on either the upper pole segment 70 and the lower pole segment 75. Further detail on the configuration of the holding blocks 30 will be provided herein below.

Figure 4:
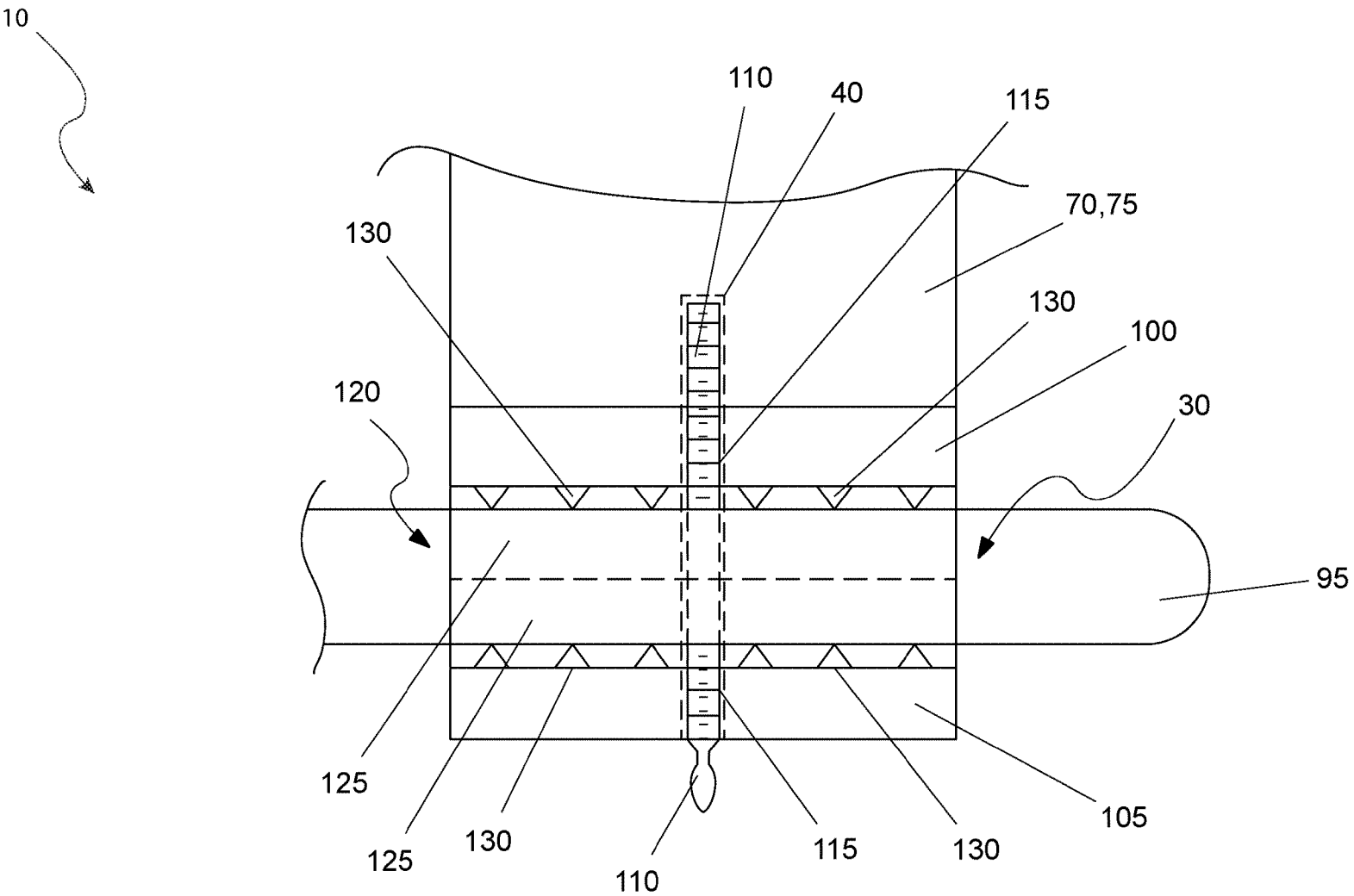
FIG. 4 is a sectional view of the fighting training device, as seen along a Line I-I, as shown in FIG. 1, according to the preferred embodiment of the present invention; and, FIG. 5 is a sectional view of the fighting training device, as seen along a Line II-II, as shown in FIG. 1, according to the preferred embodiment of the present invention.

Referring next to FIG. 4, a sectional view of the device 10, as seen along a Line I-I, as shown in FIG. 1, according to the preferred embodiment of the present invention is disclosed. This view depicts the holding blocks 30 attached to either the upper pole segment 70 or the lower pole segment 75. The handle 95 of the strike pads 25 (as shown in FIGS. 1, 2, and 3) is contained within a sleeve 120 within the holding blocks 30. The sleeve 120 comprises two (2) horizontal cylindrical segment 125, one each in the inner block 100 and the outer block 105. The interior of the horizontal cylindrical segment 125 is lined with spikes 130 to aid in gripping the soft nature of the handle 95. The third fastening means 110 is routed through the through holes 115 in the inner block 100 and the outer block 105 and secured within the threaded holes 40 in the upper pole segment 70 or the lower pole segment 75. The third fastening means 110 is envisioned to be tightened or loosened into the upper pole segment 70 or the lower pole segment 75 with only hand pressure as no tools would be required. This functionality allows for quick and easy customization of placement of the strike pads 25 along the pad placement area "a" 55 (as shown in FIG. 2).

Figure 5:
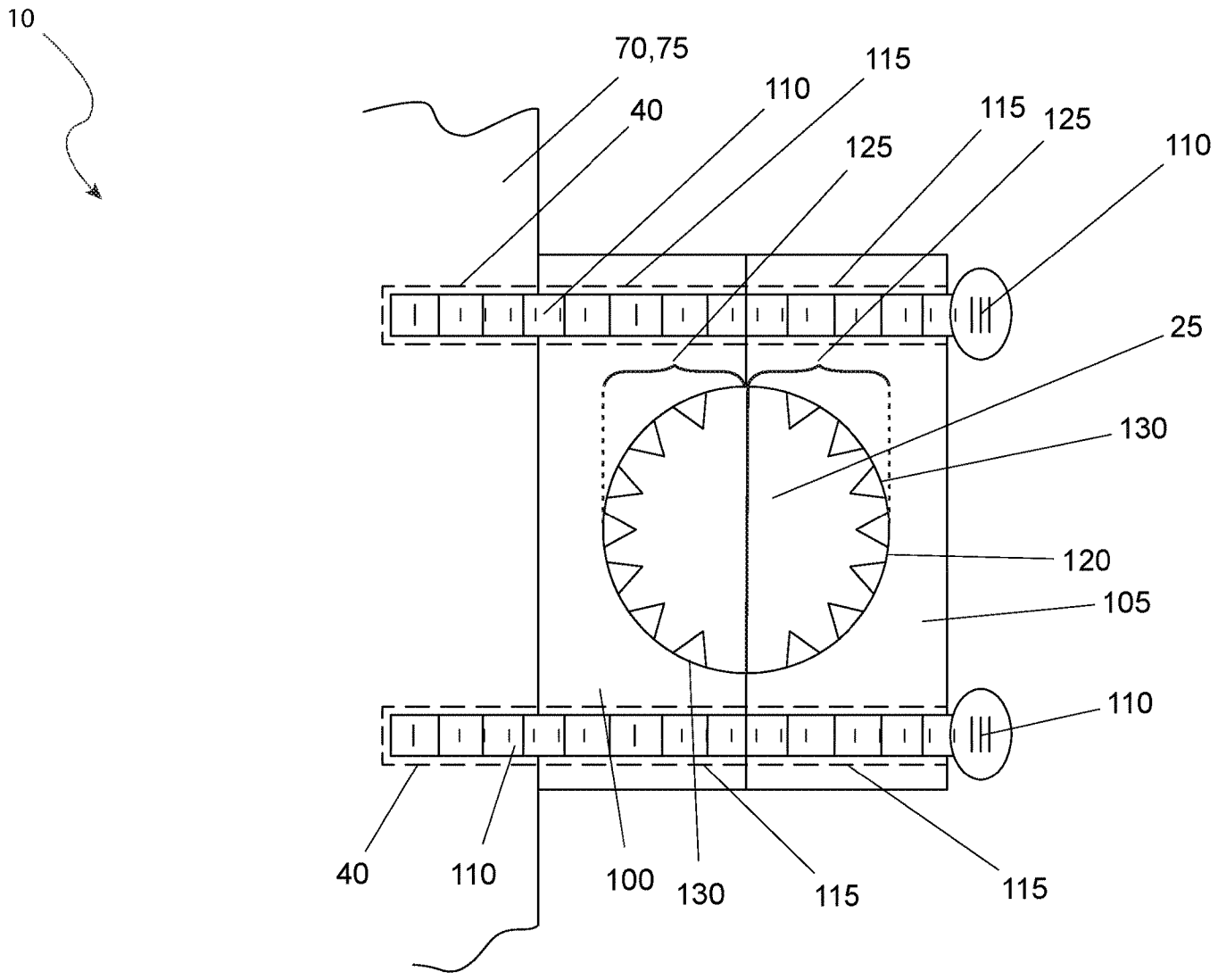

Referring finally to FIG. 5, a sectional view of the device 10, as seen along a Line II-II, as shown in FIG. 1, according to the preferred embodiment of the present invention is depicted. This view is ninety degrees (90°) opposite from the view of FIG. 4. The sleeve 120 comprising the two (2) horizontal cylindrical segment 125 with the equipped spikes 130 is readily visible with the handle 95 in the center. The third fastening means 110 is routed through the through holes 115 of the inner block 100 and the outer block 105 and into the threaded holes 40 of either the upper pole segment 70 or the lower pole segment 75.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as sporting goods stores, discount stores, department stores, mail order and internet supply houses and the like.

After procurement and prior to utilization, the device 10 would be prepared in the following manner: the base 15 would be set upon a suitable floor surface with adequate space around the base 15 for the user 45 to move when performing the hand strike travel paths "h" 60 and the foot strike travel paths "f" 65. The upper pole segment 70 and the lower pole segment 75 would be moved along the collapsing travel path "c" 85 such the components form the tower assembly 20. The lower pole segment 75 is attached to the base 15 using the second fastening means 90. The multiple strike pads 25 would be attached using the associated handle 95 in the sleeve 120 of the holding blocks 30. The holding blocks 30 would be attached to the upper pole segment 70 or the lower pole segment 75 using the third fastening means 110 into the desired threaded holes 40 along the pad placement area "a" 55. At this point in time, the device 10 is ready for use.

During utilization of the device 10, the following procedure would be initiated: the user 45, wearing appropriate sporting attire 50, engages the strike pads 25 of the device 10 with various hand strike travel paths "h" 60 and foot strike travel paths "f" 65. The usage of the device 10 allows for specific scenarios, unique to the user 45, beyond the scope of the present invention.

After use of the device 10, it may be left intact as assembled, or the device 10 may be disassembled by removing all strike pads 25 via removal of the third fastening means 110 from the holding blocks 30 and the threaded holes 40, removal of the second fastening means 90 which attach the tower assembly 20 to the base 15; and placement of all components in a storage bag or case until needed again in a cyclical manner.

The features of the device 10 is envisioned to provide the following benefits: a full range of motion; a fight-simulated movement; practicing a striking and kicking vertical movement; a portable and lightweight construction that can be disassembled and taken anywhere; limitless direction restriction on striking; manipulating the strike pads 25 turned up and down for full follow through on every punch and kick; and, more than one (1) person can use it at a time.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A fighting training device comprising:

a base a center mounted tower assembly comprising:

an upper pole segment; and, a lower pole segment; and, wherein the upper pole segment and the lower pole segment are connected by a hinge;

at least one strike pad attached to the center mounted tower assembly;

a plurality of threaded holes disposed on the center mounted tower assembly;

a first fastening means and a second fastening means connecting the center mounted tower assembly to the base; and;

wherein the center mounted tower assembly holds the at least one strike pad via a respective holding block;

wherein the plurality of threaded holes are centered on the center mounted tower assembly to allow for attachment of the respective holding block and personalized spacing of the respective holding block and the at least one strike pad;

wherein the at least one strike pad includes a handle;

wherein the handle of the at least one strike pad is contained within an inner block and an outer block of the respective holding block;

wherein a plurality of third fastening means is inserted through a plurality of through holes disposed on the inner block and the outer block;

wherein the center mounted tower assembly attached to the at least one strike pad is placed on the center mounted tower assembly along a pad placement area "a";

wherein the pad placement area "a" is adapted to accommodate a user of a plurality of heights;

wherein the third fastening means is tightened or loosened into the upper pole segment or the lower pole segment with only hand pressure as no tool would be required to allows for quick and easy customization of placement of the at least one strike pad along the pad placement area "a";

wherein the handle of the at least one strike pad is contained within a sleeve within the respective holding block; and, wherein a horizontal cylindrical segment of the inner block and the outer block is each lined with a plurality of spikes disposed inside of the horizontal cylindrical segment to aid in gripping the handle.

2. The fighting training device according to claim 1, wherein the first fastening means is a plurality of bolts.

3. The fighting training device according to claim 1, wherein the first fastening means is a plurality of screws.

4. The fighting training device according to claim 1, wherein the hinge allows the upper pole segment and lower pole segment to be folded in half along a collapsing travel path of 180° to allow for easy transport in a container.

* * * * *